US005447129A

United States Patent [19]

Kawasaki et al.

[11] Patent Number: 5,447,129

[45] Date of Patent: Sep. 5, 1995

[54] INTAKE INSULATOR

[75] Inventors: Hiroji Kawasaki, Ohme; Fujio Kobayashi, Hachioji; Yasuharu Sato, Fussa; Tadashi Ozaki, Joetsu; Yoshiaki Nagao, Tokyo, all of Japan

[73] Assignee: Kioritz Corporation, Tokyo, Japan

[21] Appl. No.: 337,449

[22] Filed: Nov. 8, 1994

[30] Foreign Application Priority Data

Nov. 16, 1993 [JP] Japan ..... 5-061650 U

[51] Int. Cl.[6] ..... F02B 33/04

[52] U.S. Cl. ..... 123/184.46; 123/73 A

[58] Field of Search ..... 123/184.21, 184.39, 123/184.32, 184.46, 73 A, 73 B, 73 C

[56] References Cited

U.S. PATENT DOCUMENTS

| | | | |
|---|---|---|---|
| 1,953,809 | 4/1934 | Kenneweg | 261/160 |
| 3,114,669 | 12/1963 | Herbst | 428/217 |
| 3,863,936 | 2/1975 | Farnam et al. | 277/166 |
| 4,228,770 | 10/1980 | Boyesen | 123/73 A |
| 4,474,145 | 10/1984 | Boyesen | 123/73 A |
| 4,498,433 | 2/1985 | Ogawa | 123/195 C |
| 4,711,225 | 12/1987 | Holderle et al. | 123/590 |
| 4,716,878 | 1/1988 | Shimada et al. | 123/540 |
| 4,768,487 | 9/1988 | Yamamoto et al. | 123/432 |
| 4,819,589 | 4/1989 | Nagashima | 123/184.23 |
| 4,835,866 | 6/1989 | Nagashima | 123/73 AD |
| 5,065,708 | 11/1991 | Wehle et al. | 123/184.61 |

FOREIGN PATENT DOCUMENTS 1-43496 12/1989 Japan .

*Primary Examiner*—David A. Okonsky
*Attorney, Agent, or Firm*—Armstrong, Westerman, Hattori, McLeland and Naughton

[57] ABSTRACT

An adiabatic intake insulator inserted into a portion for connecting a carburetor to a small two-cycle gasoline engine or the like in which the generation of cracks due to stress concentration when bolts are fastened are restrained and the looseness of the fastening member due to the shortage of fastening torque is prevented. The intake insulator comprises: portions for supporting and securing a carburetor; an intake passage through which air-fuel mixture from the carburetor is introduced to the engine; portions for securing the intake insulator to the engine each comprising a through hole for a bolt and a counterbore for accommodating a head of the bolt; and a channel formed on a circumference of a bottom of the counterbore.

2 Claims, 3 Drawing Sheets

INTAKE INSULATOR

BACKGROUND OF THE INVENTION

1. Field of the Invention

The present invention relates to an intake insulator, and more particularly to an adiabatic intake insulator inserted into a portion for connecting a carburetor to such as a small two-cycle gasoline engine or the like.

2. Description of the Related Art

Generally, in a small two-cycle internal combustion engine used for a mower or the like, an adiabatic intake insulator, which is made of synthetic resin material such as phenolic resin through injection molding for instance, is inserted into a portion for connecting a carburetor to a cylinder or a crank case of an engine. FIG. 5 shows a lateral cross-sectional view of a conventional intake insulator with the above construction. The intake insulator 1 comprises: carburetor securing portions 10 for supporting and securing a carburetor which is situated on the left side of FIG. 5 and is connected to a left end face of the intake insulator; portions 20 for securing to a cylinder of an engine which is located on the right side of FIG. 5 and contacts a right end face of the intake insulator 1; and an intake passage 15 through which air-fuel mixture from the carburetor is introduced to the engine.

Through holes 12 are formed in the direction parallel to the intake passage 15 of the intake insulator 1, and a bush 11 made of brass or the like with a female thread portion on the inner wall thereof is molded into each of the through holes 12 to provide the carburetor securing portion 10. A bolt for supporting and securing the carburetor is inserted into each of the through holes 12 from the left side and is engaged with the bush 11. Each of the portions 20 for securing to the cylinder comprises a through hole 21 for a bolt extending in parallel to the intake passage 15 of the intake insulator 1, and a counterbore 22 in which a head of the bolt is accommodated. Further, the intake passage 15 is formed at the center of the intake insultor 1 with the inner diameter thereof is gradually enlarged toward the cylinder side.

SUMMARY OF THE INVENTION

With the construction of the conventional intake insulator described above, when the intake insulator is secured to the cylinder of the engine using bolts, stress concentration occurs on the circumference of the bottom of the counterbore 22, which may cause cracks there. To prevent the generation of the cracks, the diameter of the counterbore 22 at the bottom thereof has been increased in comparison with that of the bolt, or the thickness of the insulator itself has been excessively increased more than needed for adiabatic function to prevent stress concentration at the circumference of the bottom. With the above measures, however, there is a problem of increased overall size and weight of the insulator. As another measure for preventing the generation of cracks, high-quality reinforced plastic such as FRP may be used for the insulator. However, the production cost of the insulator will be increased. The present invention has been accomplished to eliminate the drawbacks of the conventional intake insulator such as described above, and the object of the present invention is to provide an intake insulator in which the generation of cracks due to stress concentration when bolts are fastened are restrained and the looseness of the fastening member due to the shortage of fastening torque is prevented.

To accomplish the above object, an intake insulator according to the present invention comprises: portions for supporting and securing a carburetor; an intake passage through which air-fuel mixture from the carburetor is introduced to an engine; portions for securing the intake insulator to the engine each comprising a through hole for a bolt and a counterbore for accommodating a head of the bolt; and a channel formed on a circumference of a bottom of the counterbore.

BRIEF DESCRIPTION OF THE DRAWINGS

The present invention will be more apparent from the later description with reference to the accompanying drawings wherein.

DETAILED DESCRIPTION OF A PREFERRED EMBODIMENT

An intake insulator according to an embodiment of the present invention will be explained with reference to the drawings. In the FIGS. 1 to 4 for explaining one embodiment of the present invention, parts providing the same functions as those of the conventional intake insulator are indicated by the same reference symbols as used in FIG. 5, and a repeated explanation will be omitted.

Figure 1:
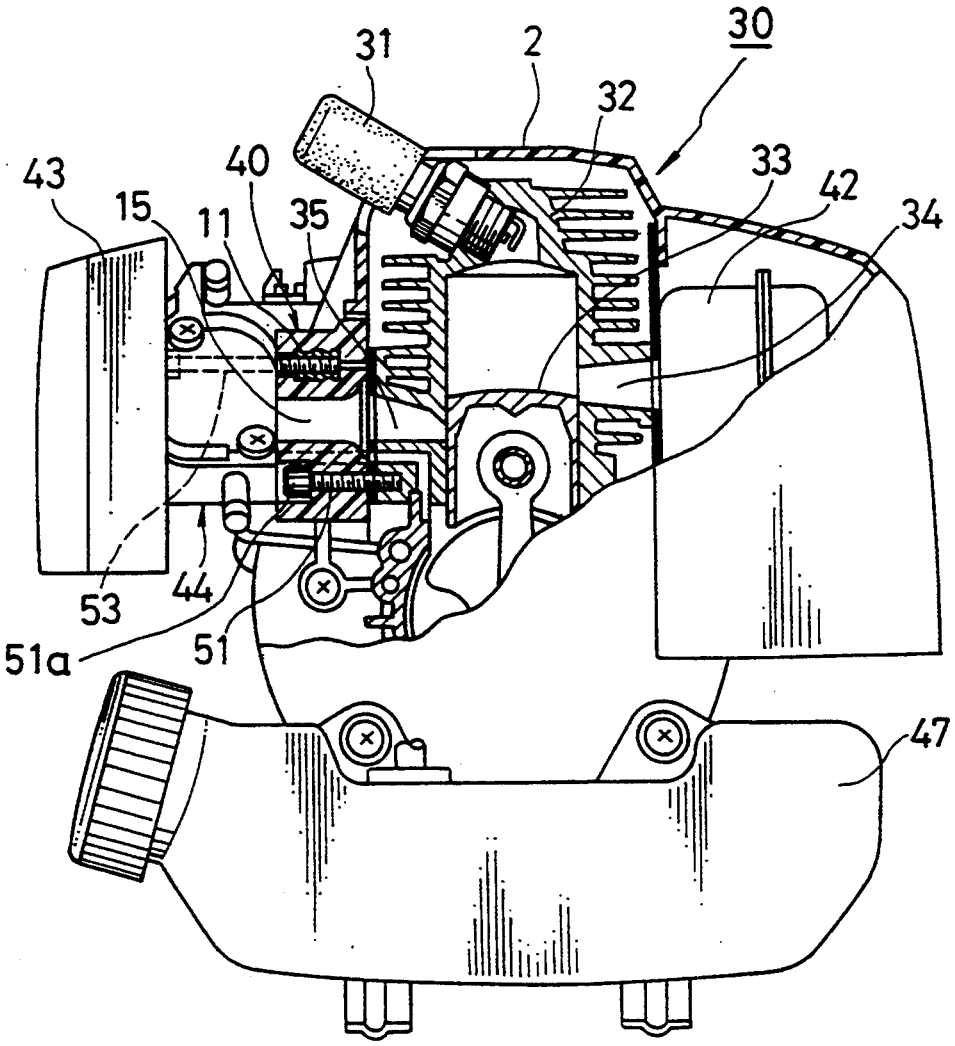
FIG. 1 is a partially fragmented cross-sectional view of a small two-cycle gasoline engine equipped with an embodiment of the present invention.
Figure 2:
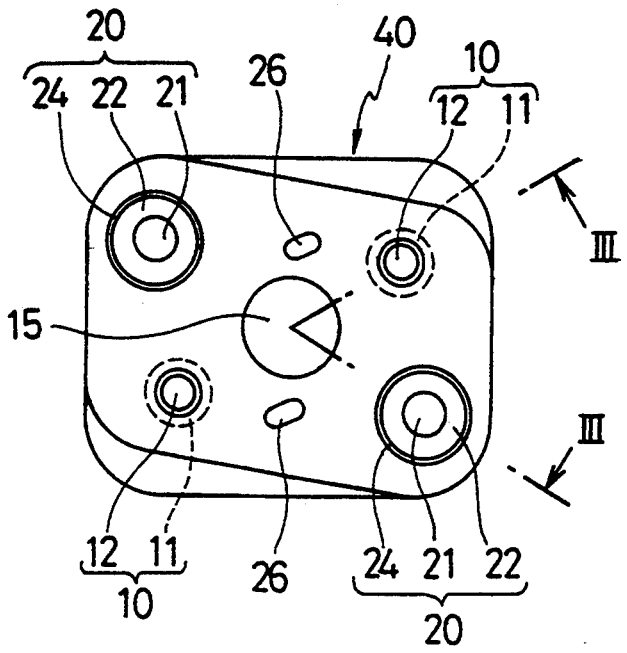
FIG. 2 is a front view of an intake insulator according to one embodiment of the present invention.

The small two-cycle gasoline engine shown in FIG. 1 has a well known construction in which a cylinder 32 with an ignition plug 31 at the top thereof is mounted to the upper portion of the engine, and a piston 33 moves up and down in the cylinder 32. The upper portion of the engine is thoroughly covered with a cylinder cover 2 from upside. The cylinder 32 is provided with an exhaust port 34 and an intake port 35, and an exhaust muffler 42 is connected to the exhaust port 34. Further, an intake insulator 40 is directly secured to the cylinder 32 with bolts 51 in such a manner that an intake passage 15 of the insulator 40 is in communication with the intake port 35. A diaphragm type carburetor 44 with an air cleaner 43 at the tip thereof is secured to the intake insulator 40 with through bolts 53 which are inserted from outside (left side in FIG. 1) and are engaged with the bushes 11. At a lower portion of the engine is situated a horizontally extending fuel tank 47.

Figure 3:
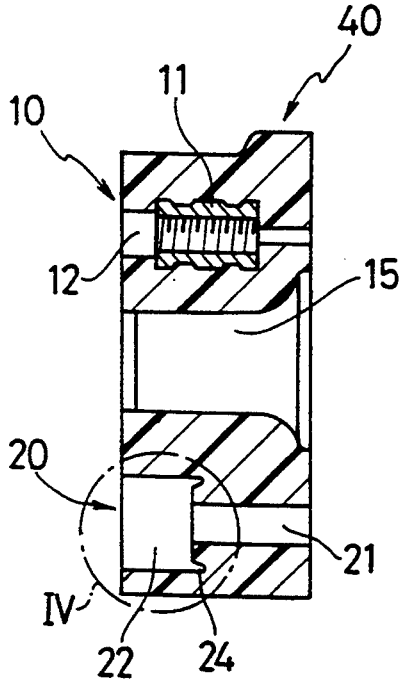
FIG. 3 is a cross-sectional view of the intake insulator taken along the line III—III of FIG. 2.
Figure 4:
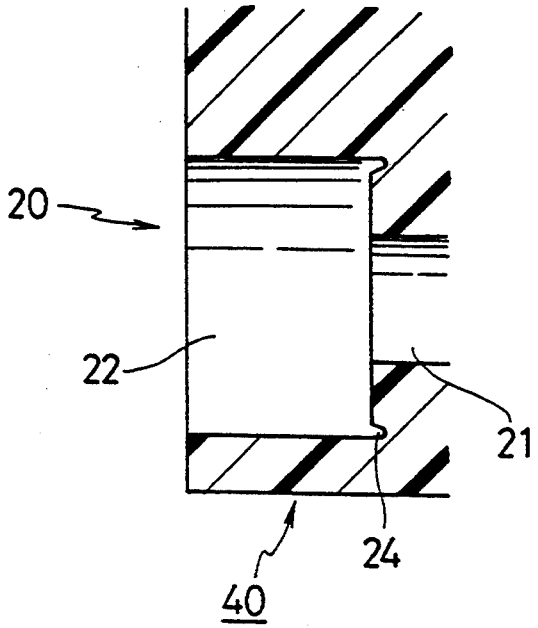
FIG. 4 is an enlarged view of the portion IV of FIG. 3.
Figure 5:
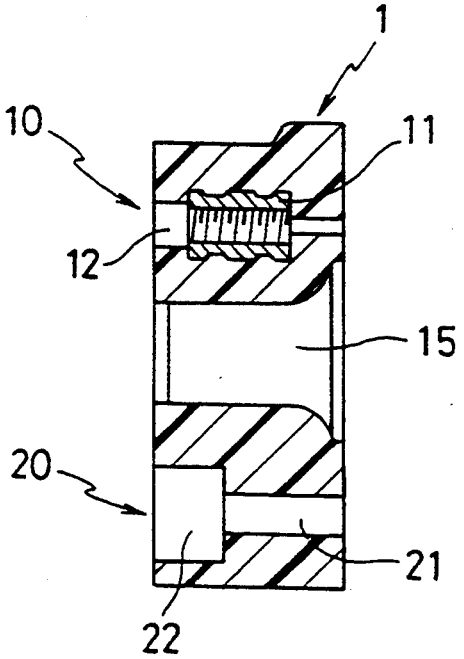
FIG. 5 PRIOR ART
FIG. 5 is a lateral cross-sectional view of a conventional intake insulator.

As clearly illustrated in FIG. 3, the intake insulator 40 according to the present invention has almost the same construction as the conventional one described above, so detailed explanation will be omitted. The intake passage 15 is formed at the center of the insulator 40, and carburetor securing portions 10 and portions 20 for securing the intake insulator 40 to the cylinder 32 are arranged at four corners of the intake insulator 40 so as to oppose to each other with the intake passage 15 in between. Further, the intake insulator 40 is provided with negative pressure intake holes 26 communicating with the carburetor 44. As illustrated in FIGS. 3 and 4, a channel 24 with a depth of approximately 0.3 mm is formed on the circumference of the bottom of the counterbore 22 on which a head 51*a* of the bolt 51 is seated.

As described above, the channel 24 is formed on the circumference of the bottom of the counterbore 22. As a result, the head 51*a* of the bolt 51 is steadily seated on the bottom of the counterbore 22; sufficient face pressure is obtained when the bolt 51 is fastened to prevent the intake insulator 40 from loosening; and the generation of cracks on the circumference of the bottom of the counterbore 22 is prevented since stress is dispersed and absorbed there. Further, since the intake insulator 40 can be made without increasing the diameter of the bottom face of the counterbore 22 in comparison with the outer diameter of the bolt 51 and without high-quality, expensive resin material, an overall size of the engine with the intake insulator 40 is prevented from becoming large and the production cost thereof will be decreased.

It is preferable to form the channel 24 on the circumference of the bottom of the counterbore 22 thoroughly, but it is possible to form the channel partially on the circumference of the bottom as occasion demands.

As described above, with the construction of the intake insulator according to the present invention, the generation of cracks due to stress concentration when bolts are fastened is restrained, and the looseness of the fastening member due to the shortage of fastening torque is prevented.

What is claimed is:

1. An intake insulator inserted into a portion connecting a carburetor to an internal combustion engine comprising:

portions for supporting and securing a carburetor;

an intake passage through which air-fuel mixture from the carburetor is introduced to the engine;

portions for securing the intake insulator to the engine each comprising a through hole for a bolt and a counterbore for accommodating a head of said bolt; and a channel formed on a circumference of a bottom of said counterbore.

2. The intake insulator as claimed in claim 1, wherein said channel is formed about the entire circumference of the bottom of the counterbore.

* * * * *